US007045960B2

(12) United States Patent
Gunter

(10) Patent No.: US 7,045,960 B2
(45) Date of Patent: May 16, 2006

(54) HIGH-PRESSURE DISCHARGE LAMP FOR MOTOR VEHICLE HEADLAMPS

(75) Inventor: Klaus Gunter, Berlin (DE)

(73) Assignee: Patent Treuhand-Gesellschaft für elektrische Glühlampen mbH, Munich (DE)

( * ) Notice: Subject to any disclaimer, the term of this patent is extended or adjusted under 35 U.S.C. 154(b) by 187 days.

(21) Appl. No.: 10/645,534

(22) Filed: Aug. 22, 2003

(65) Prior Publication Data

US 2005/0174053 A1 Aug. 11, 2005

(30) Foreign Application Priority Data

Sep. 13, 2002 (DE) ..... 102 42 740

(51) Int. Cl.
*H01J 17/20* (2006.01)

(52) U.S. Cl. ..... 313/570; 313/568; 313/634; 313/638; 313/620

(58) Field of Classification Search ..... 313/567, 313/568, 570, 573, 624, 634, 637, 638, 620
See application file for complete search history.

(56) References Cited

U.S. PATENT DOCUMENTS

| | | | | |
|---|---|---|---|---|
| 4,717,852 | A * | 1/1988 | Dobrusskin et al. | 313/634 |
| 5,973,453 | A | 10/1999 | Van Vliet | |
| 6,126,889 | A * | 10/2000 | Scott et al. | 313/624 |
| 6,137,230 | A | 10/2000 | Born | |
| 6,404,129 | B1 | 6/2002 | Hendricx et al. | 313/620 |
| 6,495,962 | B1 | 12/2002 | Uemura | |
| 6,853,140 | B1 | 2/2005 | Lapatovich | |

* cited by examiner

*Primary Examiner*—Ashok Patel
(74) *Attorney, Agent, or Firm*—William E. Meyer

(57) ABSTRACT

A high-pressure discharge lamp for motor vehicle headlamps having a mercury-free ionizable fill which consists of xenon with a cold filling pressure of at least 2000 hPa and metal halides. The discharge vessel has a tubular section (10) which consists of a transparent ceramic and has an internal diameter which is less than or equal to 2 mm and inside which there are arranged electrodes with a spacing less than or equal to 10 mm.

2 Claims, 1 Drawing Sheet

HIGH-PRESSURE DISCHARGE LAMP FOR MOTOR VEHICLE HEADLAMPS

I. TECHNICAL FIELD

Figure 1:
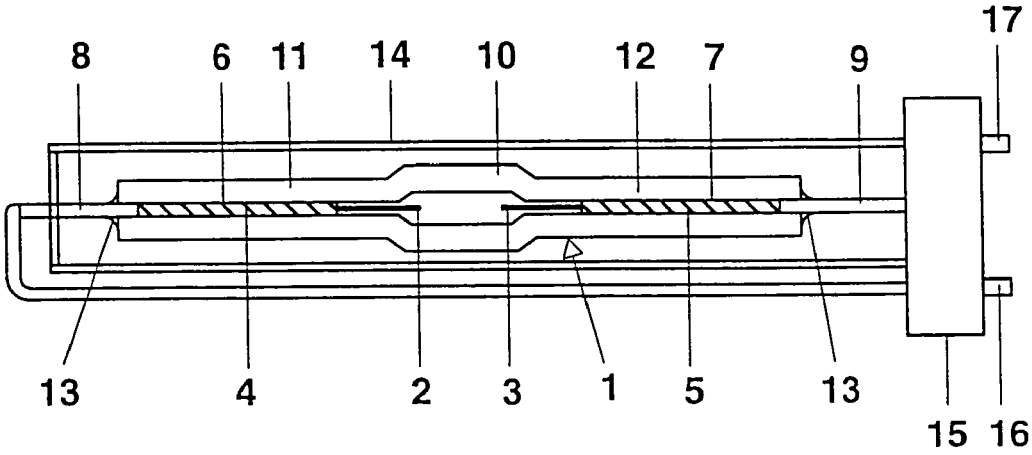

The invention relates to a high-pressure discharge lamp for motor vehicle headlamps.

II. BACKGROUND ART

Laid-open specification WO 00/67294 describes a high-pressure discharge lamp for motor vehicle headlamps having a ceramic discharge vessel which has an internal diameter of less than 2 mm and in which there is an ionizable fill. The ionizable fill comprises xenon, mercury and metal halides, in particular iodides of the metals sodium and cerium, and also, if appropriate, iodides of the metals calcium and dysprosium.

III. DISCLOSURE OF THE INVENTION

The object of the invention is to provide a high-pressure discharge lamp for motor vehicle headlamps which ensures the same illumination of the roadway as conventional mercury-containing high-pressure discharge lamps but without having to use mercury.

According to the invention, this object is achieved by the features of patent claim 1. Particularly advantageous embodiments of the invention are described in the dependent patent claims.

The high-pressure discharge lamp according to the invention for motor vehicle headlamps includes the following features:

- a discharge vessel, which has a tubular section which consists of a transparent ceramic and the internal diameter of which is less than or equal to 2.0 mm;
- two electrodes for generating a gas discharge, which are enclosed in a gastight manner in the discharge vessel and the discharge-side ends of which are arranged opposite one another in the tubular section, with the result that the distance between the discharge-side ends of the electrodes is less than or equal to 10 mm, and
- an ionizable mercury-free fill which is enclosed in the discharge vessel, is used as a discharge medium and consists of xenon with a cold filling pressure of at least 2000 hPa and metal halides.

The small dimensions of the tubular section of the discharge vessel and of the electrode spacing means that the discharge arc is considerably constricted. In particular, the extent of the discharge arc perpendicular to the longitudinal axis of the lamp is limited to exactly the internal diameter of the tubular section. By contrast, the length of the discharge arc is determined by the distance between the electrodes. Therefore, in the longitudinal direction of the lamp the light-emitting discharge arc has an extent of at most 10 mm, preferably even of at most 5 mm, and transversely to the longitudinal direction its extent is at most 2.0 mm, or even preferably only at most 1.5 mm. On account of this small extent of the discharge arc, it can be imaged sufficiently accurately in optical systems in order, for example when the lamp is used in the low-beam headlamp, to ensure the required contrast of the illumination intensity to produce the light-dark boundary without additional diaphragms. Therefore, the radiation losses in the headlamp are reduced to a minimum, and in this way the light yield losses resulting from the absence of mercury in the discharge are compensated for. The constriction of the discharge arc in the narrow tubular section results in a sufficiently high operating voltage in the abovementioned ionizable mercury-free fill, and consequently there is no need for corresponding additives to increase the operating voltage. Moreover, the abovementioned constriction of the discharge arc prevents the arc from curving upward owing to convection when the lamp is operated in the horizontal position.

On account of its high thermal load and the chemically aggressive ionizable fill, the tubular section of the discharge vessel consists of a transparent ceramic. The tubular section preferably consists of a ceramic with a particularly high light transmission. Particularly suitable ceramics for this purpose are single-crystalline sapphire, aluminum oxinitride, transparent sintered yttrium aluminum garnet or transparent sintered ytterbium aluminum garnet. These materials have a higher light transmission than transparent sintered polycrystalline aluminum oxide ceramic.

A significant advantage of the high-pressure discharge lamp according to the invention is considered to reside in the fact that its ionizable fill consists exclusively of noble gas, in particular xenon, and metal halides. In particular, the environmentally harmful component mercury is eliminated from the fill. The use of halides of the metals sodium, dysprosium, holmium, thulium and thallium together with xenon with a xenon cold filling pressure of at least 2000 hPa has proven particularly advantageous. In combination with the narrow tubular section of the discharge vessel made from transparent ceramic, preferably from single-crystalline sapphire, transparent sintered yttrium aluminum garnet, aluminum oxinitride or ytterbium aluminum garnet, this fill ensures that the high-pressure discharge lamp according to the invention illuminates the roadway just as well as the conventional mercury-containing high-pressure discharge lamp. On account of their lower chemical aggression or their vapor pressure, the iodides of the abovementioned metals are preferred to the fluorides, chlorides and bromides. A further advantage of using the halides and in particular the iodides of the metals sodium, dysprosium, holmium, thulium and thallium in combination with xenon consists in the fact that the relative proportions of sodium iodide, dysprosium iodide, holmium iodide, thulium iodide and thallium iodide in the total quantity of iodide can be selected in such a manner that the color temperature of the light emitted by the lamp is between 3500 Kelvins and 5000 Kelvins and is therefore comparable to that of conventional mercury-containing high-pressure discharge lamps.

The discharge vessel of the high-pressure discharge lamp according to the invention is advantageously surrounded by an outer bulb. The outer bulb is used to thermally insulate the discharge vessel and is therefore preferably evacuated. In addition, it can also be used to reduce the UV radiation emitted by the lamp by the outer bulb being made, for example, from a quartz glass or hard glass which absorbs UV rays. To avoid light scattering, outside the abovementioned tubular section made from transparent ceramic the discharge vessel is advantageously provided with an opaque coating. Moreover, the abovementioned coating is advantageously formed to be thermally conductive, in order to ensure a uniform distribution of the thermal load on the discharge vessel.

IV. BRIEF DESCRIPTION OF THE DRAWINGS

Figure 2:
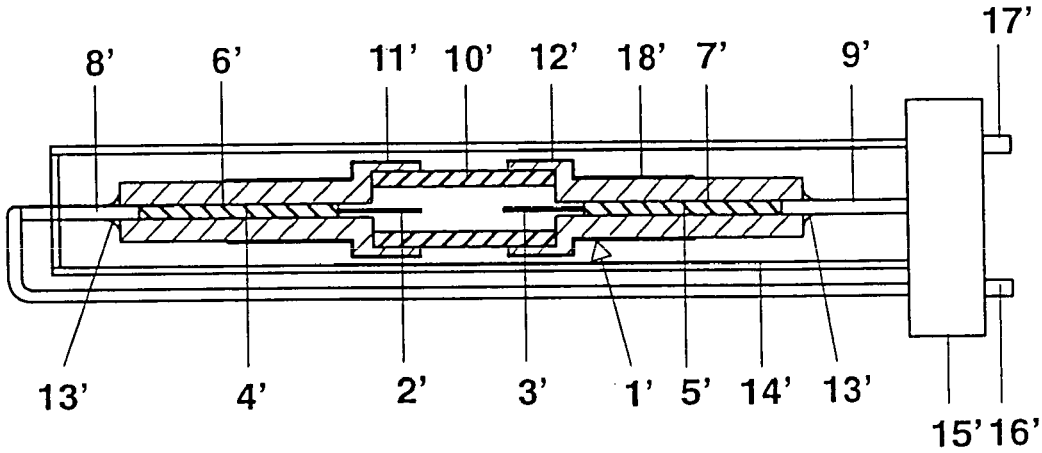

The invention is explained in more detail below with reference to two preferred exemplary embodiments. In the drawing:

FIG. 1 diagrammatically depicts a cross section through a high-pressure discharge lamp in accordance with the first exemplary embodiment of the invention;

FIG. 2 diagrammatically depicts a cross section through a high-pressure discharge lamp in accordance with the second exemplary embodiment of the invention.

V. BEST MODE FOR CARRYING OUT THE INVENTION

The first exemplary embodiment, which is illustrated in FIG. 1, shows a halogen metal vapor high-pressure discharge lamp with a power consumption of approx. 30 watts which is intended to be used in a motor vehicle headlamp. This lamp has a discharge vessel 1 made from transparent sintered ceramic comprising yttrium aluminum garnet. The discharge vessel 1 has a tubular, substantially cylindrical central section 10 and two end sections 11, 12, which are likewise tubular and extend diametrically on either side of this section 10. The internal diameter of the central section 10 is 1.5 mm. Two electrodes 2, 3 made from tungsten with a diameter of 0.3 mm are arranged in the longitudinal axis of the discharge vessel 1, so that their discharge-side ends project into the interior of the central section 10 and are spaced apart from one another by 4.2 mm. While the lamp is operating, a gas discharge arc is formed between the discharge-side ends of the electrodes 2, 3. Those ends of the electrodes 2, 3 which extend into the end sections 11, 12 are each connected to a supply conductor projecting out of the corresponding end section 11 or 12. The supply conductors are arranged in a gastight manner in the corresponding end section 11 or 12 and in each case comprise a molybdenum pin 6, 7, around which molybdenum wire 4, 5 is wound, and a niobium pin 8, 9 which is connected to the molybdenum pin and is fixed and sealed in the end section 11, 12 by means of soldering glass 13. The ionizable fill which is present in the interior of the discharge vessel 1 consists of xenon with a cold filling pressure of 5000 hPa (hectopascal) and 4 mg of the iodides of the metals sodium, dysprosium, holmium, thulium and thallium, the total quantity of iodide containing 30% by weight of sodium iodide, 20% by weight of dysprosium iodide, 20% by weight of holmium iodide, 20% by weight of thulium iodide and 10% by weight of thallium iodide. The discharge vessel 1 is surrounded by an evacuated outer bulb 14. The electrodes 2, 3 are in each case connected to an electrical terminal 16 or 17, respectively, of the lamp, which is fixed in the lamp cap 15, via the supply conductors 4, 6, 8 and 5, 7, 9, respectively.

The second exemplary embodiment of the invention, which is illustrated in FIG. 2, likewise shows a halogen metal vapor high-pressure discharge lamp with a power consumption of approx. 30 watts which is intended to be used in a motor vehicle headlamp. The discharge vessel 1' of this lamp has a tubular cylindrical central section 10' which consists of single-crystalline sapphire. The open ends of the central section 10' are in each case closed off by a closure piece 11' and 12' made from polycrystalline aluminum oxide. The closure pieces 11', 12' are each equipped with a recess for receiving one end of the central section 10' and are fixed to the corresponding end of the central section 10' by sintering. The internal diameter of the central section 10' is 1.5 mm. Two electrodes 2', 3' made from tungsten with a diameter of 0.3 mm are arranged in the longitudinal axis of the discharge vessel 1', so that their discharge-side ends project into the interior of the central section 10' and are spaced apart from one another by 4.2 mm. While the lamp is operating, a gas discharge arc is formed between the discharge-side ends of the electrodes 2', 3'. Those ends of the electrodes 2', 3' which extend into the closure pieces 11', 12' are each connected to a supply conductor projecting out of the corresponding closure piece 11' or 12'. The supply conductors are arranged in a gastight manner in the corresponding closure piece 11' or 12' and in each case comprise a molybdenum pin 6', 7', around which molybdenum wire 4', 5' is wound, and a niobium pin 8', 9' which is connected to the molybdenum pin and is fixed and sealed in the closure piece 11', 12' by means of soldering glass 13'. At least in the region of the ends of the central section 10', the outer surface of the closure pieces 11', 12' is provided with an opaque layer of niobium 18'. The ionizable fill which is present in the interior of the discharge vessel 1' consists of xenon with a cold filling pressure of 5000 hPa (hectopascal) and 4 mg of the iodides of the metals sodium, dysprosium, holmium, thulium and thallium, the total quantity of iodide containing 30% by weight of sodium iodide, 20% by weight of dysprosium iodide, 20% by weight of holmium iodide, 20% by weight of thulium iodide and 10% by weight of thallium iodide. The discharge vessel 1' is surrounded by an evacuated outer bulb 14'. The electrodes 2', 3' are in each case connected to an electrical terminal 16' or 17', respectively, of the lamp, which is fixed in the lamp cap 15', via the supply conductors 4', 6', 8' and 5', 7', 9', respectively.

What is claimed is:

1. A high-pressure discharge lamp for motor vehicle headlamps, comprising:

a discharge vessel, which has a tubular section which consists of a transparent sapphire ceramic and the internal diameter of which is less than or equal to 2.0 mm; two electrodes for generating a gas discharge, which are enclosed in a gastight manner in the discharge vessel and the discharge-side ends of which are arranged opposite one another in the tubular section, with the result that the distance between the discharge-side ends of the electrodes is less than or equal to 10 mm, and an ionizable mercury-free fill which is enclosed in the discharge vessel, is used as a discharge medium and consists of xenon with a cold filling pressure of at least 2000 hPa and halides of the metals sodium, dysprosium, holmium, thulium and thallium.

2. The high-pressure discharge lamp as claimed in claim 1, wherein relative to the total iodide quantity, 30 percent by weight is sodium iodide, 20 percent by weight is dysprosium iodide, 20 percent by weight is holmium iodide, 20 percent by weight is thulium iodide and 10 percent by weight is thallium iodide.

* * * * *